US005086979A

United States Patent [19]

Koblish et al.

[11] Patent Number: 5,086,979

[45] Date of Patent: Feb. 11, 1992

[54] SMALL AIRBLAST FUEL NOZZLE WITH HIGH EFFICIENCY INNER AIR SWIRLER

[75] Inventors: Theodore R. Koblish, Birmingham; Leonard D. Bell, Ferndale, both of Mich.

[73] Assignee: Fuel Systems Textron Inc., Zeeland, Mich.

[21] Appl. No.: 376,751

[22] Filed: Jul. 7, 1989

[51] Int. Cl.[5] ..... B05B 7/10

[52] U.S. Cl. ..... 239/404; 239/406

[58] Field of Search ..... 239/400, 403, 404, 405, 239/406, 468, 492, 497

[56] References Cited

U.S. PATENT DOCUMENTS

| | | | |
|---|---|---|---|
| 1,451,063 | 4/1923 | Anthony | 239/404 |
| 2,368,827 | 2/1945 | Hanson et al. | 239/405 |
| 2,821,437 | 1/1958 | Lesher | 239/403 |
| 3,657,885 | 4/1972 | Bader | 60/39.74 R |
| 3,980,233 | 9/1976 | Simmons et al. | 239/404 |
| 4,105,163 | 8/1978 | Davis, Jr. et al. | 239/405 |
| 4,263,780 | 4/1981 | Stettler | 60/39.23 |
| 4,434,766 | 3/1984 | Matsuoka et al. | 123/472 |
| 4,698,014 | 10/1987 | Grethe et al. | 431/9 |
| 4,761,959 | 8/1988 | Romey et al. | 60/740 |

*Primary Examiner*—Andres Kashnikow

*Assistant Examiner*—Karen B. Merritt

*Attorney, Agent, or Firm*—Reising, Ethington, Barnard, Perry & Milton

[57] ABSTRACT

The small airblast fuel nozzle improves cold ignition of small gas turbine engines of the type having a stagnation air pressure of only 1-1-1/2 inches of water available from the compressor for cold ignition. The fuel nozzle includes an inner air swirling system comprising a longitudinal cylindrical inner air swirl chamber and multiple air inlet slots spaced circumferentially on the nozzle body to supply air to the chamber. The air inlet slots each include an inner tapered section converging toward and into intersection with the chamber and an outer tapered section converging from the exterior of the nozzle body toward and into intersection with the inner section. The inner section and outer section are canted with respect to one another and in the same direction from one slot to the next so that the inner air slots collectively form a hooked cross type pattern when viewed in plan. The inner air swirl system is effective to provide much enhanced air swirling in the inner chamber with a high efficiency or use of the small available stagnation air pressure available at the nozzle exterior for improved cold ignition.

21 Claims, 7 Drawing Sheets

Fig-1
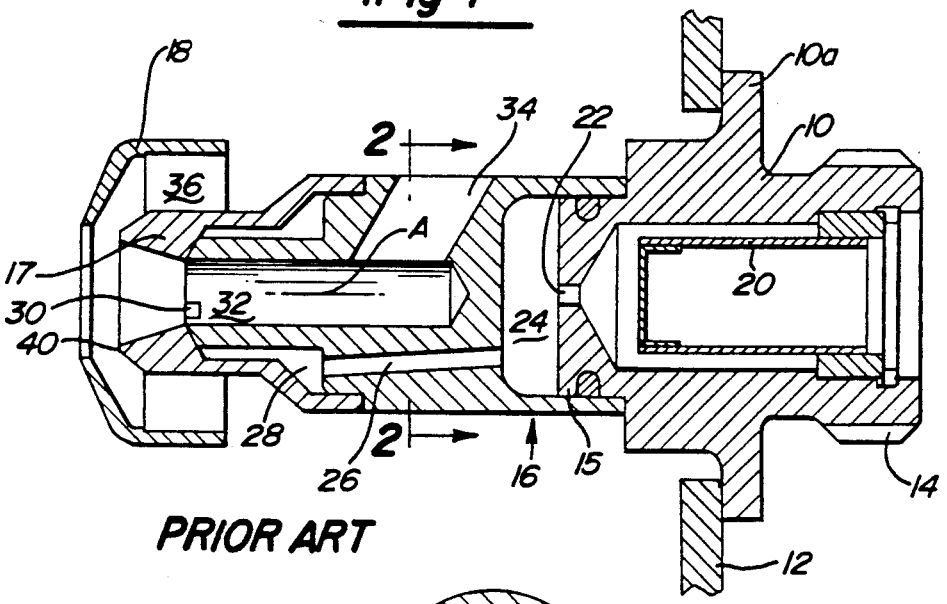
PRIOR ART
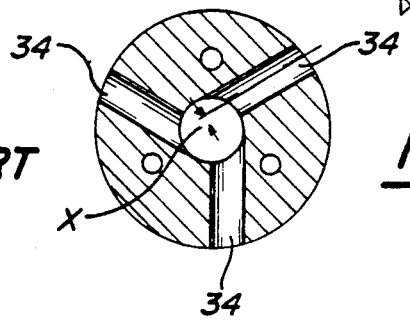
PRIOR ART
Fig-2
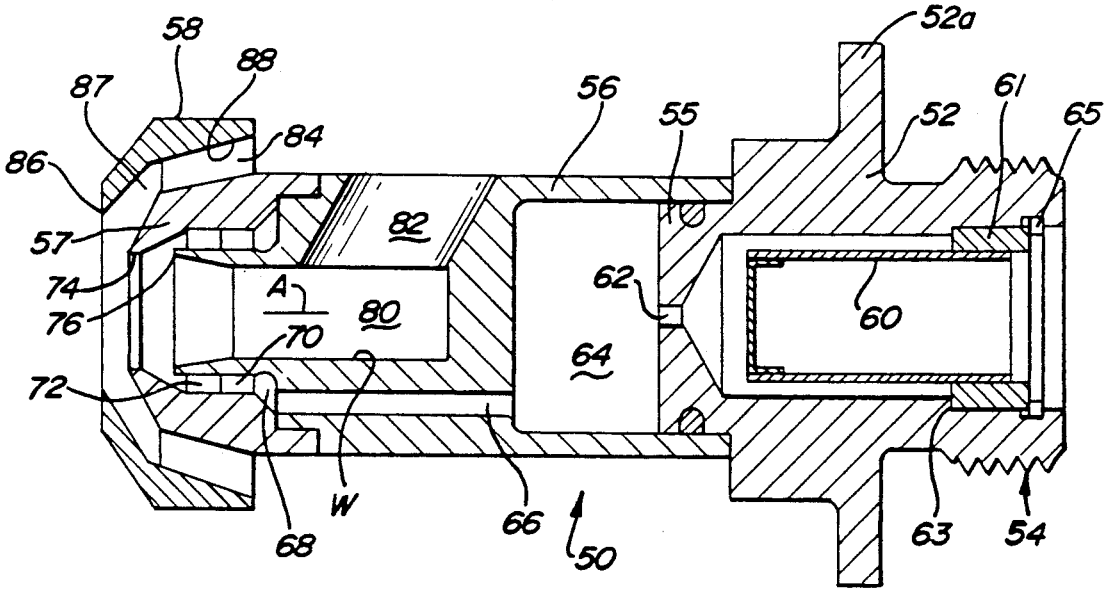
Fig-3

Fig-4
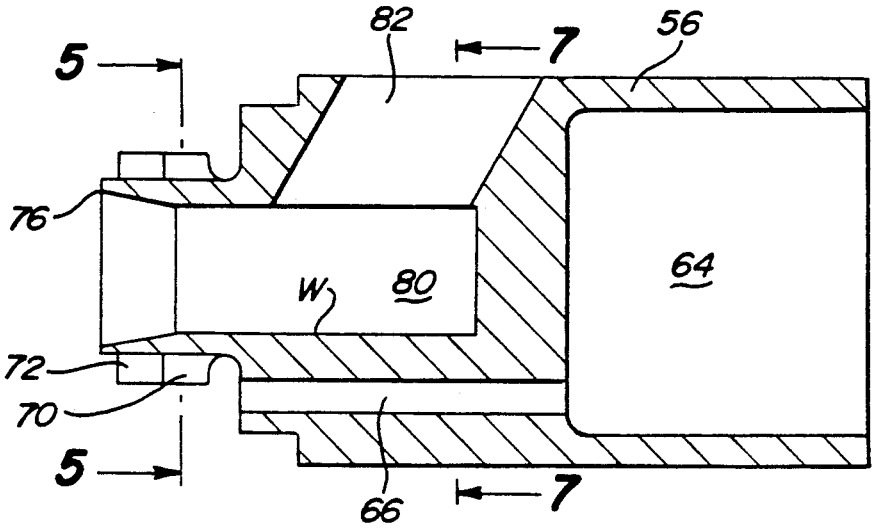
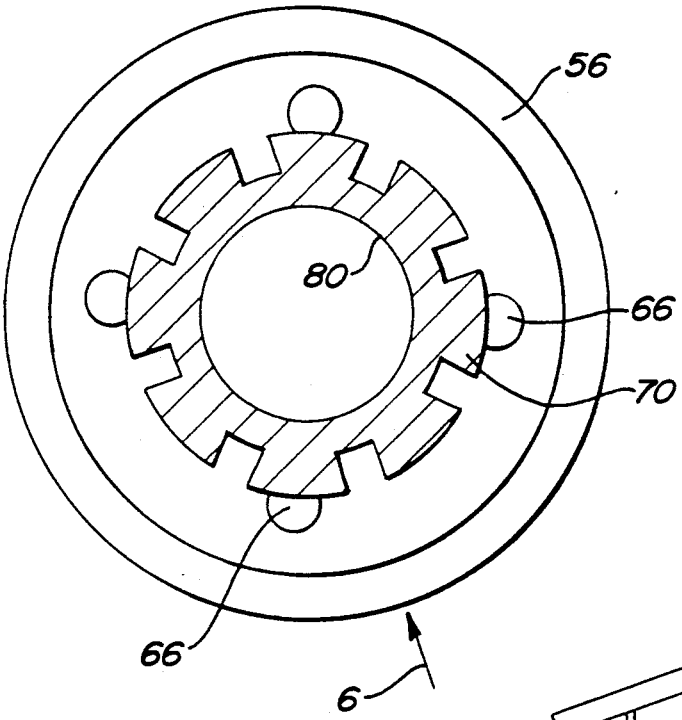
Fig-5
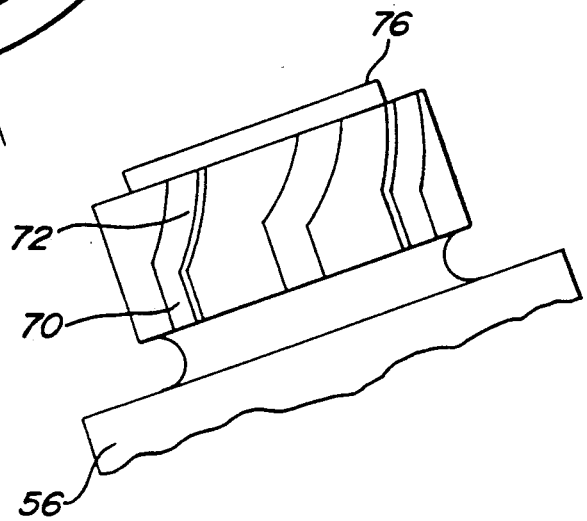
Fig-6

Fig-7
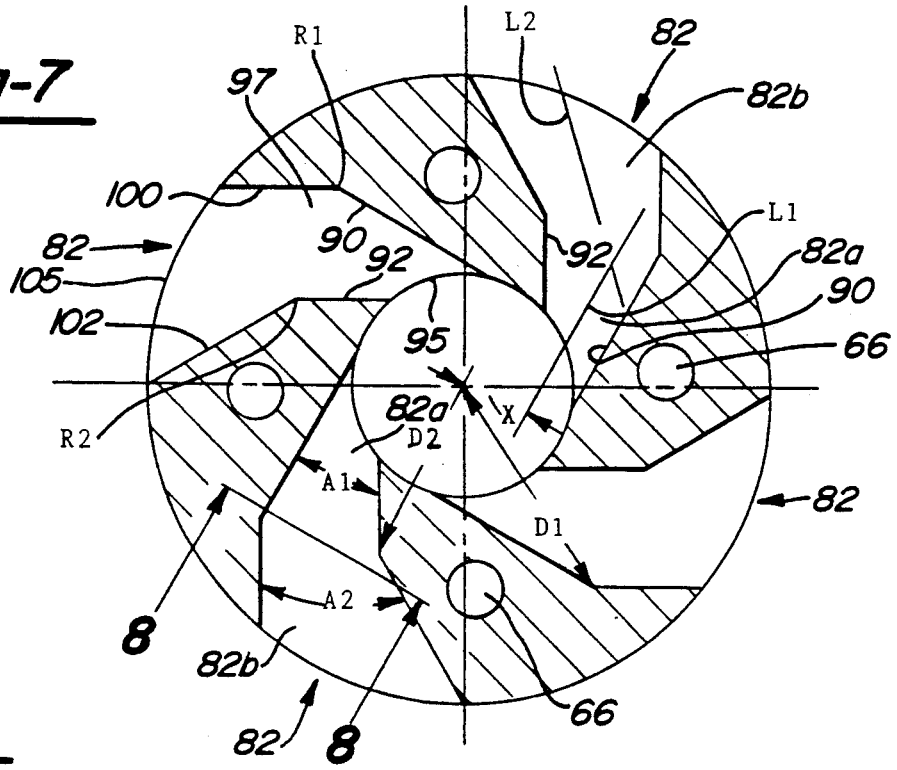
Fig-8
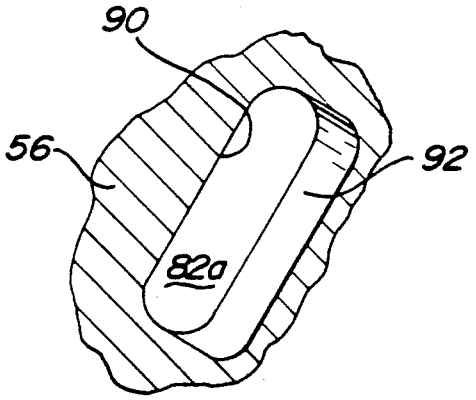
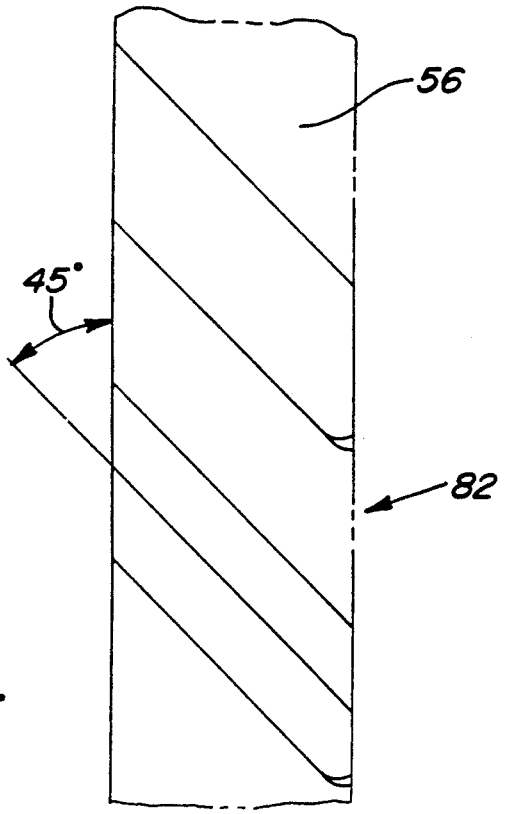
Fig-9

PRESSURE PROFILE
AXIS POSITION
-.8 -.7 -.6 -.5 -.4 -.3 -.2 -.1 0 .1 .2 .3 .4 .5 .6 .7 .8
CENTRAL AXIS
AIR INLET
82
W

-.8 -.7 -.6 -.5 -.4 -.3 -.2 -.1 0 .1 .2 .3 .4 .5 .6 .7 .8 .9
AIR INLET
82
W

-.8 -.7 -.6 -.5 -.4 -.3 -.2 -.1 0 .1 .2 .3 .4 .5 .6 .7 .8
W

-.8 -.7 -.6 -.5 -.4 -.3 -.2 -.1 0 .1 .2 .3 .4 .5 .6 .7 .8
W

-.10 -.9 -.8 -.7 -.6 -.5 -.4 -.3 -.2 -.1 0 .1 .2 .3 .4 .5 .6 .7 .8
W

-.9 -.8 -.7 -.6 -.5 -.4 -.3 -.2 -.1 0 .1 .2 .3 .4 .5 .6 .7 .8 .9
W

0
.1
.2
.3
.4
RADIAL POSITION

PRESSURE PROFILE
AXIAL POSITION
-.8 -.7 -.6 -.5 -.4 -.3 -.2 -.1 0 .1 .2 .3 .4 .5 .6 .7 .8
0 .1 .2 .3 .4
82'
W'

-.8 -.7 -.6 -.5 -.4 -.3 -.2 -.1 0 .1 .2 .3 .4 .5 .6 .7 .8 .9
0 .1 .2 .3 .4
AIR INLET
82'
W'

-.8 -.7 -.6 -.5 -.4 -.3 -.2 -.1 0 .1 .2 .3 .4 .5 .6 .7 .8
0 .1 .2 .3 .4
W'

RADIAL POSITION
-1.1 -1.0 -.9 -.8 -.7 -.6 -.5 -.4 -.3 -.2 -.1 0 .1 .2 .3 .4 .5 .6 .7 .8
0 .1 .2 .3 .4
CENTRAL AXIS
W'

-1.0 -.9 -.8 -.7 -.6 -.5 -.4 -.3 -.2 -.1 0 .1 .2 .3 .4 .5 .6 .7 .8
0 .1 .2 .3 .4
W'

-.9 -.8 -.7 -.6 -.5 -.4 -.3 -.2 -.1 0 .1 .2 .3 .4 .5 .6 .7 .8 .9
0 .1 .2 .3 .4
82'
W'

PRESSURE PROFILE (PRIOR ART)
AXIS POSITION
$H_2O$
-.8 -.7 -.6 -.5 -.4 -.3 -.2 -.1 0 .1 .2 .3 .4 .5 .6 .7 .8
0 .1 .2 .3 .4
WALL OF CHAMBER 32
AIR INLET PASSAGE 32

-.7 -.6 -.5 -.4 -.3 -.2 -.1 0 .1 .2 .3 .4 .5 .6 .7 .8

-.6 -.5 -.4 -.3 -.2 -.1 0 .1 .2 .3 .4 .5 .6 .7 .8
CENTRAL AXIS

-.6 -.5 -.4 -.3 -.2 -.1 0 .1 .2 .3 .4 .5 .6 .7 .8

-.8 -.7 -.6 -.5 -.4 -.3 -.2 -.1 0 .1 .2 .3 .4 .5 .6 .7 .8

-.8 -.7 -.6 -.5 -.4 -.3 -.2 -.1 0 .1 .2 .3 .4 .5 .6 .7 .8
WALL OF CHAMBER 32
AIR INLET 32

RADIAL POSITION

SMALL AIRBLAST FUEL NOZZLE WITH HIGH EFFICIENCY INNER AIR SWIRLER

FIELD OF THE INVENTION

The invention relates to airblast type fuel nozzles for small gas turbine engines and, in particular, such airblast fuel nozzles having high efficiency inner air swirlers to aid cold fuel ignition performance.

BACKGROUND OF THE INVENTION

FIGS. 1 and 2 illustrate a small airblast fuel nozzle used in the past in small gas turbine engines of, for example, 1000–2000 horsepower. These airblast fuel nozzles include a first nozzle body 10 having a flange 10*a* by which the nozzle is mounted to the combustor wall 12 and an upstream threaded inlet fitting 14 connected to a fuel conduit. A second nozzle body 16 is attached by welding and the like on the front tubular extension 15 of the first nozzle body. Attached on the downstream end of the second nozzle body is nozzle tip 17 having outer air shroud 18 therearound.

Fuel enters the nozzle through fitting 14 and passes through filter 20 past flow restrictor orifice 22 into chamber 24. Fuel from chamber 24 flows through drilled circumferentially spaced passages 26 to annular chamber 28 and through a transverse slot (not shown) to discharge orifice 30 in the air swirl chamber 32 for atomization by swirling air exiting therefrom.

Swirl air for chamber 32 enters circumferentially spaced air inlet passages 34 which as shown extend in radially and forwardly inclined directions relative to axis A. The air inlet passages intersect the swirl chamber 32 in a tangential manner as shown in FIG. 2. The purpose of air inlet passages 34 is to impart sufficient swirl to air as it enters chamber 32 and flows therealong to effect sufficient atomization of fuel at discharge orifice 30 to ignite same in the presence of a spark ignition.

Outer air passing inside shroud 18 is also swirled by swirl vanes 36 to aid fuel atomization as the previously atomized fuel exits from discharge lip 40 for injection into the combustor.

In these small gas turbine engines low stagnation air pressure; e.g., 1–1½ inches of water, is available from the compressor section of the engine at cold ignition for entering air inlet passage 34 and swirling along swirl chamber 32. At these low air pressure values, there has been a problem with achieving cold ignition on a consistent basis; i.e., the engines have been difficult to start.

What is needed is a solution to the problem of inconsistent and difficult cold ignition of such small gas turbines having only low stagnation air pressure available from the compressor at cold ignition.

SUMMARY OF THE INVENTION

An object of the invention is to provide a solution to the aforesaid problem wherein an airblast fuel nozzle is provided capable of effecting sufficient fuel atomization by air swirl enhancement at the aforesaid low compressor stagnation air pressure available in small gas turbine engines to provide improved cold ignition characteristics.

The invention relates to the discovery that the low cold ignition stagnation air pressure in combination with a low efficiency inlet air passages restrict the amount of inner cylindrical air swirl strength that can be generated in the inner air swirl chamber of such airblast fuel nozzles.

In particular, low efficiency of inner air swirling is severely limited by the small inner diameter of the inner cylindrical air swirl chamber. For example, the small airblast fuel nozzles of the type shown typically have an inner cylindrical air swirl chamber with a maximum inner diameter of 0.12 inch as a result of the need to maintain the wall thickness of the nozzle body therearound at a sufficient thickness to provide required structural strength.

The small diameter of the inner air swirl chamber exerts an adverse effect on the amount of swirl strength capable of generation since the degree of swirl strength decreases as the distance "X" (FIG. 2) between the centerline of air inlet passages and the centerline of the inner cylindrical air swirl chamber decreases. The small inner diameter of the inner cylindrical air swirl chamber is thus inherently self limiting since it cannot be increased and still maintain the same nozzle body envelope (outer dimension and profile of the nozzle body) designed for the particular gas turbine engine.

The present invention provides the aforementioned solution within the constraints imposed by such small airblast fuel nozzles and the small gas turbine engines in which they are used (low cold ignition stagnation air pressure) so that the improved airblast fuel nozzles of this invention can be substituted for those of the type shown in FIGS. 1 and 2; i.e., the improved nozzle characteristics are provided in substantially the same nozzle body envelope without substantially altering the inner diameter of the cylindrical inner air swirl chamber.

In particular, the invention contemplates a novel high efficiency design for the air inlet passages conducting and imparting swirl to inner air entering the inner cylindrical air swirl chamber to achieve sufficient inner air swirling to provide enhanced cold ignition at low ignition air pressure.

The invention also contemplates such small airblast fuel nozzles having high efficiency inner air inlet passages from the standpoint that significantly higher stagnation air pressure is available for swirl promotion at the entrance of the passages into the inner cylindrical air swirl chamber wherein of the original 1–1½ inch water of stagnation air pressure available greater than 0.70 inch water, and preferably greater 0.90 inch water, is still present as the air enters the inner cylindrical air swirl chamber. This compares to only about 0.30 inch water available in the prior art nozzle design of FIGS. 1–2.

The invention also contemplates an improved method of igniting a gas turbine engine having such an initial air stagnation pressure (i.e., about 1–1½ inches of water).

The invention achieves the above objects and advantages by providing multiple circumferentially spaced air inlet slots with a novel slot configuration that attempts to maximize the value of the "X" dimension referred to above while at the same time attempting to minimize adverse air pressure losses through the slots to the inner cylindrical air swirl chamber.

BRIEF DESCRIPTION OF THE DRAWINGS

FIG. 1 is a longitudinal sectional view through a prior art airblast fuel nozzle for a small gas turbine engine.

FIG. 2 is a sectional view taken along lines 2—2 of FIG. 1.

FIG. 3 is a longitudinal sectional view through an airblast fuel nozzle of the invention for the same gas turbine engine.

FIG. 4 is a sectional view of the second nozzle body of the fuel nozzle of FIG. 3.

FIG. 5 is a sectional view taken along lines 5—5 of FIG. 4.

FIG. 6 is an elevation taken in the direction of arrow 6 in FIG. 5.

FIG. 7 is a sectional view taken along lines 7—7 of FIG. 4.

FIG. 8 is a sectional view taken along lines 8—8 of FIG. 7.

FIG. 9 is a sectional view of the fuel system swirler slots.

DETAILED DESCRIPTION OF THE INVENTION

Figure 10:
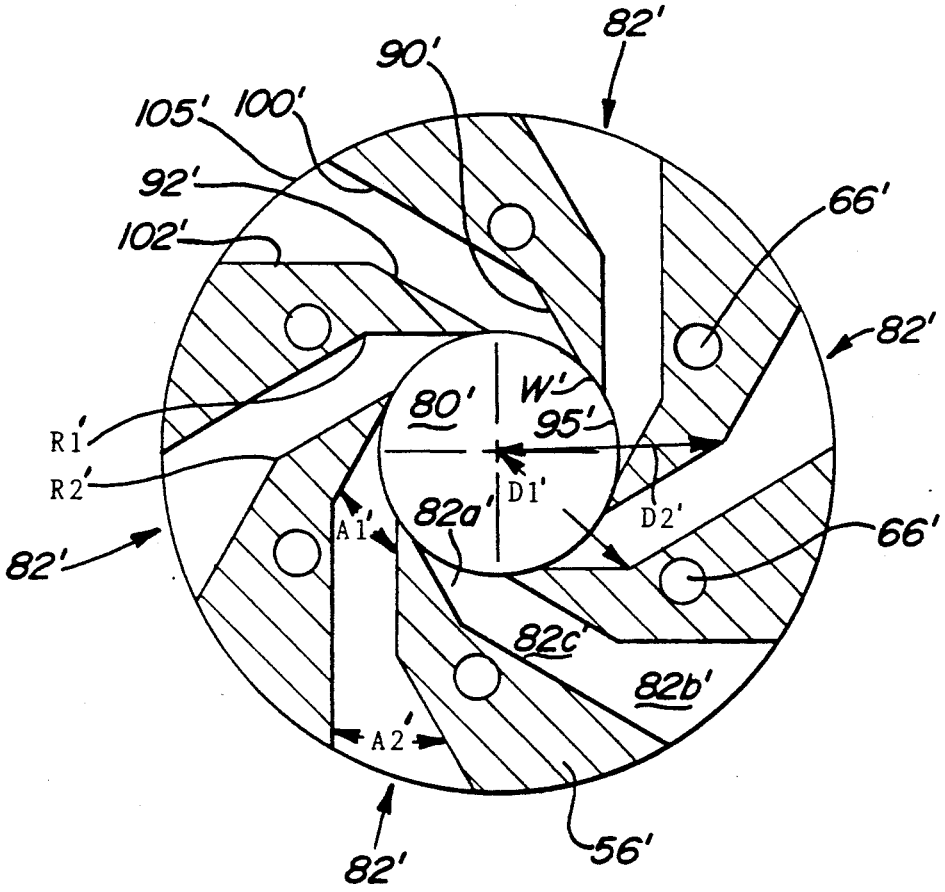
FIG. 10 is a sectional view similar to FIG. 7 for a second embodiment of the invention.

Referring to FIGS. 3-9, a first embodiment of the airblast fuel nozzle 50 is shown as including a first nozzle body 52 having an annular circular (in plan) flange 52*a* by which the nozzle is mounted to the combustor wall 12 (FIG. 1) and a threaded inlet fitting 54 connected to a fuel conduit (not shown) in usual fashion.

A second nozzle body 56 is attached by welding, brazing and the like on the front downstream tubular extension 55 of first nozzle body 54. Attached on the downstream end of the second nozzle body is nozzle tip 57 having outer air shroud 58 therearound. Nozzle body 56 has a cylindrical outer profile or shape.

Fuel enters the fuel nozzle through fitting 54 and passes through fuel filter 60 and cylindrical flow restrictor orifice 62 into cylindrical chamber 64. Fuel filter 60 is supported on collar 61 which is held against internal shoulder 63 in position by snap-ring 65. Fuel from chamber 64 flows through drilled circumferentially spaced cylindrical fuel passages 66 to annular fuel chamber 68 and through annular chamber 70 past fuel swirl passages 72 for discharge past annular fuel discharge lip 74 on nozzle tip 57. Swirling inner air discharges past annular inner air discharge lip 76 from cylindrical inner air swirl chamber 80 which receives air through a plurality of circumferentially spaced air inlet passages 82 which extend in radially and forwardly inclined directions relative to axis A. Outer air passing inside shroud 58 is swirled by swirl vanes 84 for discharge past outer air discharge lip 86 after passing through swirl chamber 87.

The second nozzle body 56 has an outer radius that is equal to or greater than two times the inner radius of inner air swirl chamber 80.

As is known, air entering inner air passages 82 and entering chamber 88 of outer air shroud 58 is provided by the compressor (not shown) of the gas turbine engine in which combustor 12 is disposed.

The inner air and outer air discharged past respective discharge lips 76 and 86 atomizes the fuel discharging past discharge lip 74.

As mentioned hereinabove, in small gas turbine engines outputting 1000-2000 horsepower, the compressor provides relatively low stagnation air pressure at cold ignition for inner air entering inlet passages 82 and outer air entering shroud 58. At these low stagnation air pressure values, there has been difficulty in achieving cold ignition on a consistent basis and as a result the engines have been difficult to start.

In accordance with the invention, the efficiency of inner air inlet passages 82 has been dramatically improved to provide a higher proportion of stagnation air pressure for the inner air entering inner air swirl chamber 80 for swirl promotion therein and to provide a geometry that enhances the degree of swirl strength capable of generation in chamber 80. As an exemplary illustration, for 1 to 1½ inch water of cold ignition stagnation air pressure available at the entrance to inner air inlet passages 82, the improved efficiency passages 82 provide a measured air pressure greater than 0.70 inch water and preferably greater than 0.90 inch water at the juncture of passage 82 and inner air swirl chamber 80; i.e., where the inner air flows enter the chamber 80 after having passed through passages 82. These values compare to only about 0.30 inch water measured stagnation air pressure available at the same juncture for the prior art airblast fuel nozzle of FIGS. 1-2.

The geometry of the improved inner air inlet passages 82 increases the aforementioned distance "X" between centerline of each inner air inlet passage 82 and the centerline of the inner air said chamber 80 to increase swirl strength capable of generation in chamber 80 and to improve location of the maximum swirl of inner air close to the wall W defining inner air swirl chamber 80.

Referring to FIGS. 7 and 8, the shape of inner air inlet passages 82 in accordance with one embodiment of the invention is shown. Each inner air inlet passage 82 includes an inner tapered section 82*a* converging toward and into intersection with inner air swirl chamber 80 and an outer tapered section 82*b* converging toward and intersecting with the inner section 82*a*.

In particular, inner section 82*a* comprises a first wall 90 that is tangent to inner air swirl chamber 80 at its juncture with wall W forming chamber 80, and a second wall 92 spaced and disposed angularly from first wall 90 in the counterclockwise direction relative to FIG. 7. Walls 90,92 thus define a selected included angle A1 therebetween. Second wall 92 intersects wall W in a non-tangent relation and, if projected across the chamber 80, constitutes a chordal line through the cylindrical air swirl chamber 80 of the second nozzle body 56. Together, converging walls 90,92 define an outlet 95 into chamber 80 through which inner air flow enters into chamber 80 from each passage 82 and an inlet 97 at their diverging radially remote ends. It is apparent that as a result of the convergence of walls 90,92, inlet 97 has a greater cross-sectional effective air flow area than outlet 95. As shown in FIG. 8, each inner section 82*a* has a generally rectangular profile with rounded corners.

Tangent wall 90 extends a radial distance D1 while non-tangent wall 92 extends a radial distance D2 toward the outer circumference of nozzle body 56.

Outer section 82*b* of each passage 82 comprises a first wall 100 that intersects first wall 90. As is apparent, first wall 100 is substantially parallel to second wall 92 and, if projected across the nozzle body 56, would also constitute a chordal line therethrough. First wall 100 intersects first wall 90 at a point R1.

Outer section 82*b* also includes second wall 102 that is angularly disposed relative to first wall 100 and intersects second wall 92 at a point R2. Distance D2 is less than distance D1.

Walls 100,102 converge toward the inner section 82*a* and define an outlet coincident with inlet 97 of the inner section. Walls 100,102 define an inlet 105 in the outer circumference of nozzle body 56 to receive compressor discharge air. The inlet 105 of outer section 82*b* is greater in cross-sectional effective air flow area than its outlet into the inner section 82*a*.

The ratio of the air flow area of the inlet end of the outer section 82*b* to the outlet end of the inner section 82*a* is equal to or greater than 2.5, preferably 2.75.

Walls 100,102 are angularly displaced relative to the respective walls 90,92 in the same counterclockwise direction relative to FIG. 7. The included angle A2 defined between walls 100,102 is greater than included angle A1 defined between walls 90,92.

Each outer section 82*b* has a generally rectangular profile with rounded corners like that illustrated in FIG. 8.

It is apparent that inner air inlet passages 82 define hooked cross type pattern of passages in nozzle body 56 when viewed as shown in FIG. 7 and that longitudinal axis L1 of inner section 82*a* and longitudinal axis L2 of outer section 82*b* intersect to form an obtuse angle when so viewed.

Figures 11A, 11B, 11C, 11D, 11E, 11F:
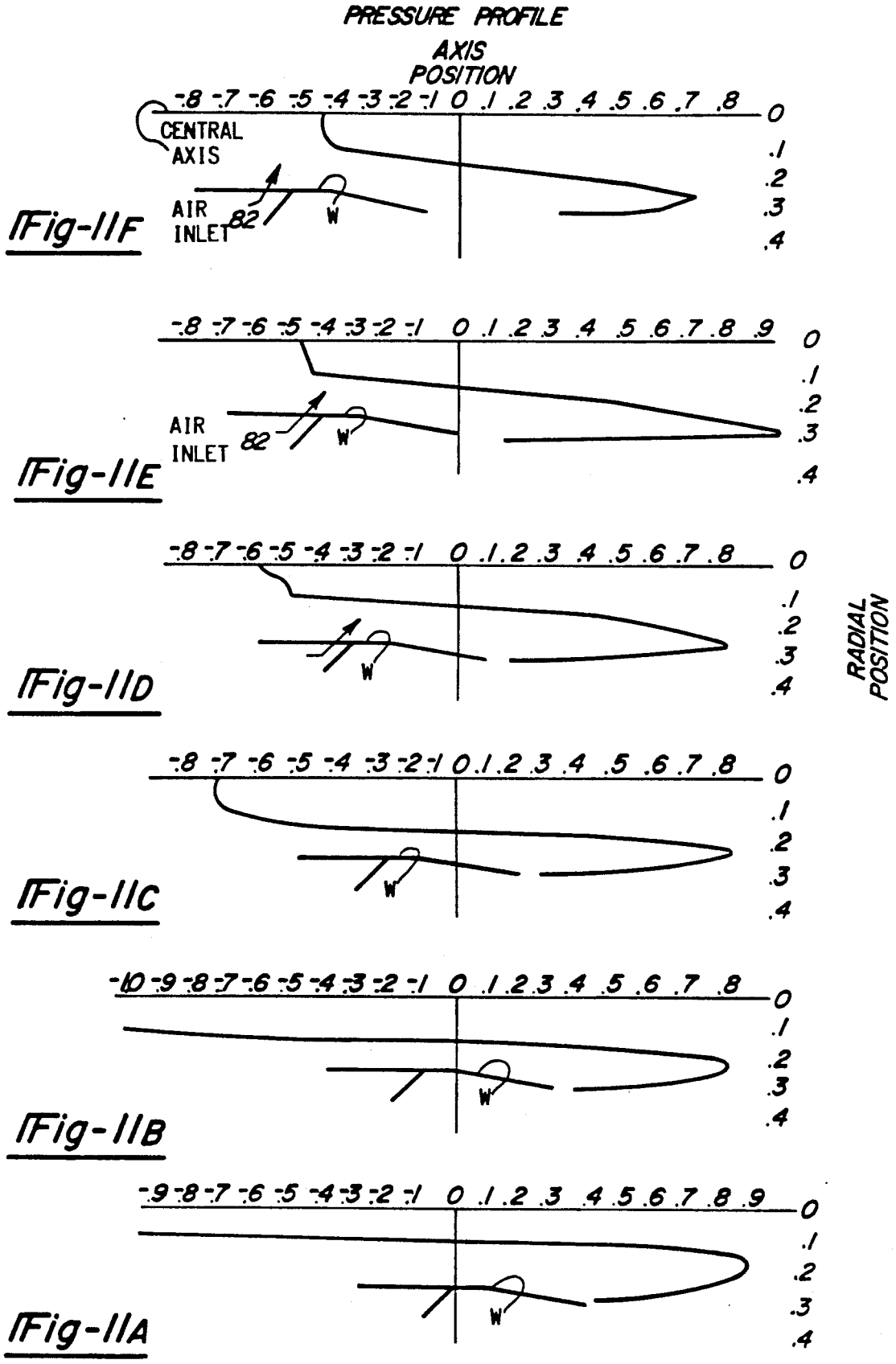
FIGS. 11A-F and 12A-F are pressure profile diagrams for nozzles of the invention measured at different axial locations along the nozzle central axis.
Figures 12A, 12B, 12C, 12D, 12E, 12F:
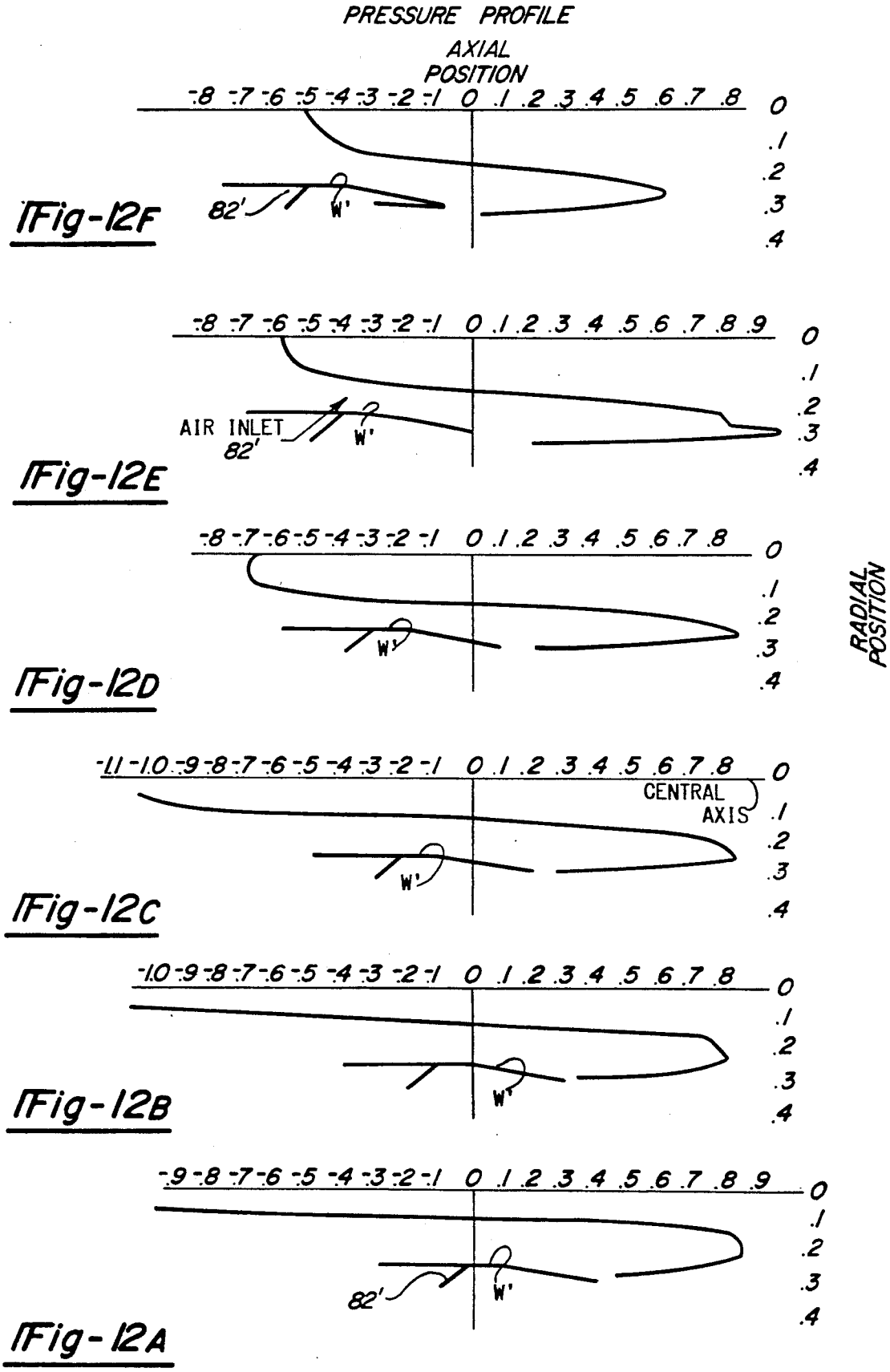

FIGS. 11 *a–f* illustrate measured pressure profiles at various radial distances from the longitudinal central axis of inner air swirl chamber 80 of the fuel nozzle 50 of FIGS. 3–9 at different axial locations (designated with the vertical "O" axis position line) relative to inner air inlet passages 82. Note that the axial location of measurement moves toward air inlet passages 82 as one proceeds from FIG. 11F through FIG. 11A. Only one half of the chamber 80 is shown since the pressure profile is generally symmetrical around the longitudinal central axis. Air entering inner air inlet passages 82 was supplied at 1.0 inch water stagnation air pressure.

It is apparent that the air inlet passages 82 are effective to provide a measured maximum air pressure in chamber 80 that is greater than 0.9 inch water, FIG. 11(*e*), and a maximum air pressure that is closely adjacent wall W forming chamber 80 having radius of 0.24 inches in FIGS. 11(*a*)–(*f*). The pressure profile shown in FIGS. 11(*a*)–(*f*) was determined on a fuel nozzle scaled up in dimensions by about four (4) times (hence the radius of 0.24) to enable a pressure probe to be inserted in the air swirl chamber 80 without adversely disrupting the aerodynamics of the highly swirling air flow in the chamber. The same aerodynamics exhibited by the upscaled fuel nozzle (e.g., as shown in FIGS. 11(*a*)–(*f*)) would be exhibited upon down scaling of the fuel nozzle to actual size for use in the aforementioned small gas turbine engines of 1000–2000 horsepower; e.g., to provide a maximum inner diameter of the air swirl chamber 80 of about 0.12 inch.

FIG. 10 illustrates a second embodiment of the invention where the inner air inlet passages have a slightly different configuration. The features of the second embodiment of FIG. 10 are similar to those of the first embodiment of FIGS. 3–9 and like features are represented by like reference numerals primed.

The primary difference between second embodiment of FIG. 10 and the first embodiment relate to the number of inner air inlet passages 82' and the dimensions of walls 90',92',100',102'.

In particular, it is apparent that there are six passages 82'. Also, there are six circumferentially space fuel passages 66' extending axially through nozzle body 56'.

It is also apparent that the first point of intersection R1' of first wall 90' of inner section 82*a'* and first wall 100' of outer section 82*b'* and the point of intersection R2 of second wall 92' and second wall 102' are different in that the distance D1' of the first point of intersection is less than distance D2' of the second point of intersection. Included angle A1 is less than included angle A2.

The second embodiment of FIG. 10 can be viewed as having inner section 82*a'*, outer section 82*b'* and an intermediate section 82*c'* therebetween. Inner section 82*a'* converges toward and into intersection with chamber 80'. Intermediate section 82*c'* has a constant cross-sectional air flow area. Outer section 82*b'* converges toward and into intersection with the intermediate section. Air flows from outer section 82*b'* through intermediate section 82*c'* and then into inner section 82*a'* for discharge into inner air swirl chamber 80'.

FIGS. 12*a–f* illustrate measured pressure profiles at various radial distances from the central axis of inner air swirl chamber 80' of the second embodiment at different axial locations (see vertical "O" axis position line) relative to inner air inlet passages 82'. Only one-half of chamber 80' is shown since the pressure profile is generally symmetrical around the longitudinal central axis. Air entering inner air inlet passages 82' was supplied at 1.0 inch water stagnation air pressure. The fuel nozzle was scaled up by about four times for testing for the reasons given hereinabove.

It is apparent that the air inlet passages 82' are effective to provide a measured maximum air pressure in chamber 80' that is greater than 0.9 inch water, FIG. 12(*e*), and a maximum air pressure that is closely adjacent wall W' forming chamber 80' having radius 0.24 inches in FIGS. 12(*a*)–(*f*).

Figures 13A, 13B, 13C, 13D, 13E, 13F:
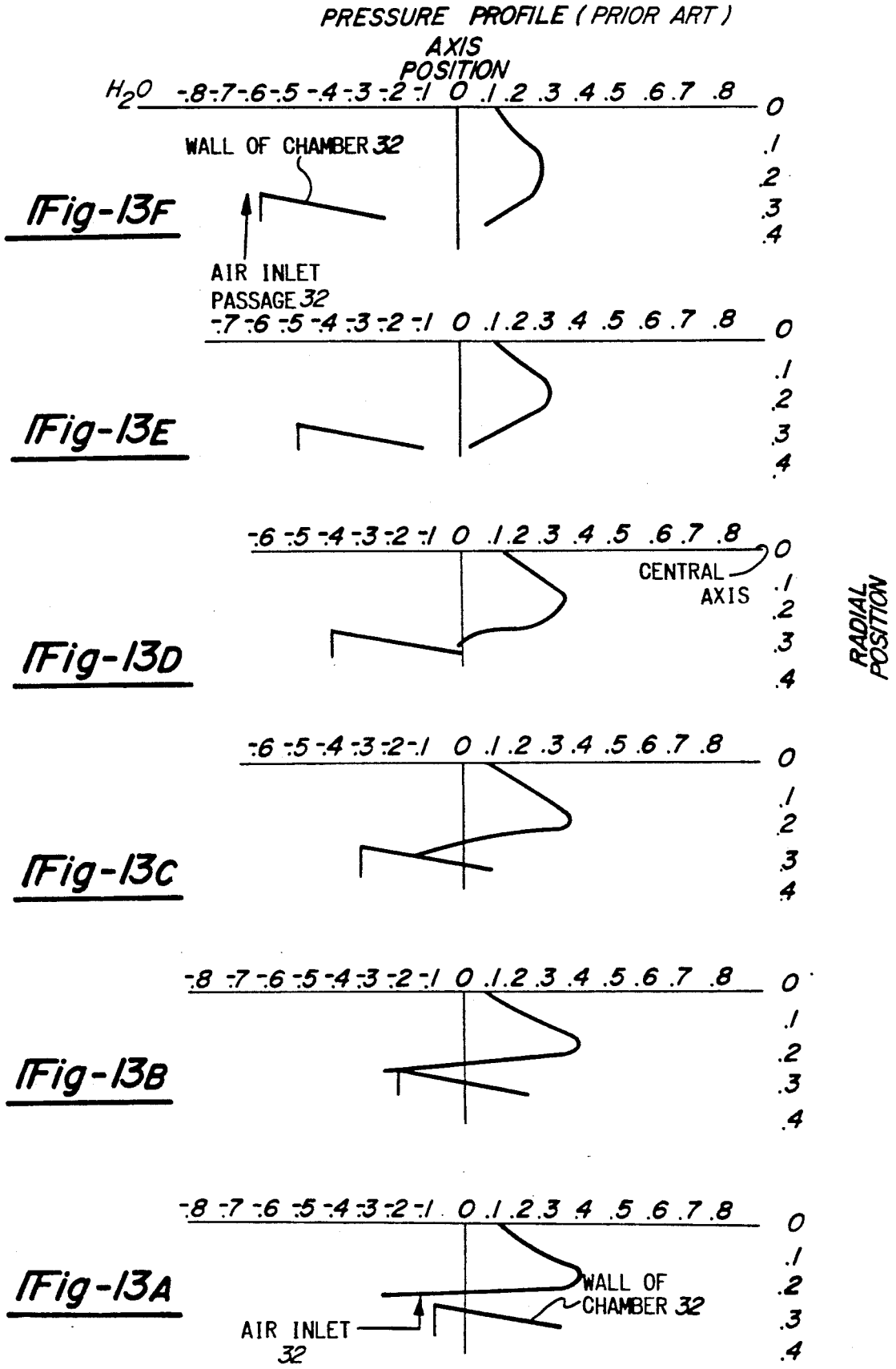
FIG. 13A-F are similar to FIGS. 11A-F and 12A-F but for the prior art nozzle.

Similar pressure profiles for the prior art fuel nozzle of FIGS. 1 and 2 (upscaled in dimension by about four times) are shown in FIGS. 13(*a*)–(*f*). The dramatic improvement of the first and second embodiments of the invention in improving air swirl in the inner air swirl chamber as compared to the prior art fuel nozzle is evident. Not only is the maximum air pressure in the inner air swirl chamber at least twice as great as that of the prior art fuel nozzle but also the maximum air swirl (maximum pressure) is closer to the wall defining the inner air swirl chamber.

As mentioned above, these improvements are achievable in substantially the same inner nozzle body envelope without substantially altering the inner diameter of the inner air swirl chamber.

While there have been described in the foregoing specification the preferred modes for practicing the invention, it is our intent to cover in the appended claims all modifications thereof as fall within the spirit and scope of the invention as set forth in the appended claims.

We claim:

1. An airblast fuel nozzle for a gas turbine engine comprising a nozzle body having a longitudinal inner air swirl chamber with a downstream discharge orifice, means for discharging fuel from the nozzle body and a plurality of air inlet passages circumferentially spaced apart around the nozzle body upstream of the fuel discharge orifice and extending from the inner air swirl chamber to the exterior of the nozzle body for receiving air flow, each air inlet passage having an inner section converging toward and intersecting with the inner air swirl chamber and an outer section converging toward and intersecting with the inner section, said inner section having an outlet communicating with said inner air swirl chamber and an inlet communicating with said outer section, said outer section having an outlet communicating with the inlet of said inner section and an inlet on the exterior of said nozzle body for receiving said air flow, the convergence of said outer section and inner section being selected to provide an effective air flow area through said outer section greater than the effective air flow area through said inner section, said inner section and outer section of each air inlet passage being relatively canted in the same circumferential direction and oriented relative to said air swirl chamber to, in effect, provide a distance "X" between centerlines of said air swirl chamber and said inner section that increases the air swirl strength achievable in said air swirl chamber at a given air pressure value at the inlet of said outer section.

2. The nozzle of claim 1 wherein a longitudinal axis of said inner section and longitudinal axis of said outer section intersect to form an obtuse angle.

3. The nozzle of claim 1 wherein the inner section includes a first wall and second wall and the outer section includes a first wall and second wall, the first walls of said inner section and outer section intersecting to form an obtuse angle and the second walls of said inner section and outer section intersecting to form a obtuse angle.

4. The nozzle of claim 1 wherein the air inlet passages are in a hooked cross type pattern.

5. An airblast fuel nozzle for a gas turbine engine comprising a nozzle body having a cylindrical longitudinal inner air swirl chamber with a downstream discharge orifice, means for discharging fuel from the nozzle body and a plurality of air inlet passages spaced apart around the nozzle body upstream of the fuel discharge orifice and extending from the inner air swirl chamber to the exterior of the nozzle body for receiving air flow, each air inlet passage having an inner section converging toward and intersecting with the inner air swirl chamber, an outer section converging toward the inner section and an intermediate section in air flow relation to said inner section and outer section, said intermediate section having a substantially constant air flow area with the convergence of said outer section and inner section being selected to provide an effective air flow area through said outer section greater than the effective air flow area through said inner section.

6. An airblast fuel nozzle for a gas turbine engine comprising a nozzle body having a cylindrical longitudinal inner air swirl chamber with a downstream discharge orifice, means for introducing fuel into the chamber and a plurality of air inlet slots circumferentially spaced apart around the nozzle body upstream of the fuel discharge orifice and extending from the chamber to the exterior of the nozzle body for receiving air flow, each air inlet slot having an inner tapered section converging toward and intersecting with the chamber with a first wall of the inner section intersecting tangent to the chamber and a second wall spaced and disposed angularly thereto at a selected included angle to form an outlet end communicating with the chamber and an inlet end with the inlet end having a larger air flow area than the outlet end and each air inlet slot further having an outer tapered section converging toward and intersecting with the inner section with a first wall and second wall of the outer section intersecting the respective first wall and second wall of the inner section so as to form an inlet end in the exterior of the nozzle body for the outer section and an outlet end for the outer section for supplying air to the inlet end of the inner section, said inlet end of the outer section having a larger air flow area than said outlet end of the inner section, said inner section and outer section of each air inlet slot being relatively canted in the same circumferential direction and oriented relative to said air swirl chamber to, in effect, provide a distance "X" between centerlines of said air swirl chamber and said inner section that increases the air swirl strength achievable in said air swirl chamber at a given air pressure value at the inlet and of said outer section.

7. The nozzle of claim 6 wherein the second wall of the inner section and first wall of the outer section are angularly oriented relative to the first wall of the inner section to the same extent so that they are substantially parallel.

8. The nozzle of claim 6 wherein the second wall of the first section is non-tangent to the chamber and, if projected through the chamber, constitutes a chordal line therethrough.

9. The nozzle of claim 8 wherein the first wall of the outer section, if projected through the nozzle body, constitutes a chordal line therethrough.

10. The nozzle of claim 6 wherein the first walls of the inner section and outer section intersect at a first distance from the center of the chamber and the second walls of the inner section and outer section intersect at a second distance different from the first distance.

11. The nozzle of claim 6 wherein the ratio of the outer radius of the exterior of the nozzle body to the inner radius of the chamber is equal to or greater than 2.

12. The nozzle of claim 6 wherein, in section, each air slot has a general rectangular profile with rounded corners.

13. The nozzle of claim 6 wherein each air slot extends through the nozzle body at an angle relative to the chamber.

14. The nozzle of claim 6 wherein the ratio of the area of the inlet end of the outer section to the outlet end of the inner section is equal to or greater than 2.75.

15. The nozzle of claim 6 wherein the air slots are effective to provide an air pressure value in the chamber at least 90% of the air pressure value at the inlet end of the outer section.

16. The nozzle of claim 6 wherein the air slots are effective to provide air pressure in the chamber having an air pressure value at least 90% of the stagnation air pressure value at the inlet end of the outer section when the latter air pressure value is about 1 to about 1½ inch water air pressure.

17. An airblast fuel nozzle for a gas turbine engine comprising a nozzle body having a cylindrical longitudinal inner air swirl chamber with a downstream discharge orifice, means for introducing fuel into the chamber and a plurality of air inlet passages spaced apart around the nozzle body upstream of the fuel discharge orifice and extending from the chamber to the exterior of the nozzle body for receiving air flow, each air inlet passage having an inner tapered section converging toward and intersecting with the chamber with a first wall of the inner section intersecting tangent to the chamber and a second wall spaced and disposed angularly thereto at a selected included angle to form an outlet end communicating with the chamber and an inlet end with the inlet end having a larger air flow are a than the outlet end and each air inlet passage further having an outer tapered section converging toward and intersecting with the inner section first wall and second wall of the outer section intersecting the respective first wall and second wall of the inner section and angularly disposed relative to the respective first wall and second wall of the inner section and in the same direction as the angular disposition of the second wall of the inner section relative to the first wall thereof to form an inlet end in the exterior of the nozzle body for the outer section and outlet end for the outer section for supplying air to the inlet end of the inner section, said second wall of the inner section and said first wall of the outer section being angularly oriented relative to the first wall of said inner section to the same extent so that they are substantially parallel, said inlet end of the outer section having a larger air flow area than the said outlet end of inner section.

18. The nozzle of claim 17 wherein the second wall of the first section is non-tangent to the chamber and, if projected through the chamber, constitutes a chordal line therethrough.

19. The nozzle of claim 18 wherein the first wall of the outer section, if projected through the nozzle body, constitutes a chordal line therethrough.

20. An airblast fuel nozzle for a gas turbine engine comprising a nozzle body having a cylindrical longitudinal inner air swirl chamber with a downstream discharge orifice, means for introducing fuel into the chamber and a plurality of air inlet passages spaced apart around the nozzle body upstream of the fuel discharge orifice and extending from the chamber to the exterior of the nozzle body for receiving air flow, each air inlet passage having an inner tapered section converging toward and intersecting with the chamber with a first wall of the inner section intersecting tangent to the chamber and a second wall spaced and disposed angularly thereto at a selected included angle to form an outlet end communicating with the chamber and an inlet end with the inlet end having a larger air flow area than the outlet end and each air inlet passage further having an outer tapered section converging toward and intersecting with the inner section with a first wall and second wall of the outer section intersecting the respective first wall and second wall of the inner section and angularly disposed relative to the respective first wall and second wall of the inner section and in the same direction as the angular disposition of the second wall of the inner section relative to the first wall thereof to form an inlet end in the exterior of the nozzle body for the outer section and outlet end for the outer section for supplying air to the inlet end of the inner section, said first walls of the inner section and the outer section intersecting at a first distance from the center of the air swirl chamber and said second walls of the inner section and the outer section intersecting at a second distance different from the first distance, said inlet end of the outer section having a larger air flow area than said outlet end of the inner section.

21. An airblast fuel nozzle for a gas turbine engine comprising a nozzle body having a cylindrical longitudinal inner air swirl chamber with a downstream discharge orifice, means for discharging fuel from the nozzle body and a plurality of air inlet passages circumferentially spaced apart around the nozzle body upstream of the fuel discharge orifice and extending from the inner air swirl chamber to the exterior of the nozzle body for receiving air flow, each air inlet passage having an inner section converging toward and intersecting with the inner air swirl chamber, an outer section converging toward the inner section and an intermediate section in air flow relation to said inner section and said outer section, said intermediate section having a substantially constant air flow area with the convergence of said outer section and inner section being selected to provide an effective air flow area through said outer section greater than the effective air flow area through said inner section, said inner section and outer section of each air inlet passage being relatively canted in the same circumferential direction and oriented relative to said air swirl chamber to, in effect, provide a distance "X" between centerlines of said air swirl chamber and said inner section that increases the air swirl strength achievable in said air swirl chamber at a given air pressure value at the inlet of said outer section.

* * * * *

UNITED STATES PATENT AND TRADEMARK OFFICE

CERTIFICATE OF CORRECTION

PATENT NO. : 5,086,979

DATED : February 11, 1992

INVENTOR(S) : Theodore R. Koblish et al.

It is certified that error appears in the above-identified patent and that said Letters Patent is hereby corrected as shown below:

Column 8, line 15, delete "and" and insert --end-- therefor;

Column 9, lines 1 and 2, delete "are a" and insert --area-- therefor.

Signed and Sealed this

Tenth Day of August, 1993

*Attest:*

Michael K. Kirk

MICHAEL K. KIRK

*Attesting Officer*

*Acting Commissioner of Patents and Trademarks*